US006628912B2

(12) United States Patent
Amemiya et al.

(10) Patent No.: US 6,628,912 B2
(45) Date of Patent: Sep. 30, 2003

(54) CHARGE ROLLER FOR AN IMAGE FORMING APPARATUS AND METHOD OF PRODUCING THE SAME

(75) Inventors: Ken Amemiya, Tokyo (JP); Takaya Muraishi, Yokohama (JP); Takatsugu Fujishiro, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/960,354

(22) Filed: Sep. 24, 2001

(65) Prior Publication Data

US 2002/0037180 A1 Mar. 28, 2002

(30) Foreign Application Priority Data

Sep. 25, 2000 (JP) ..... 2000-291330

(51) Int. Cl.[7] ..... G03G 15/02
(52) U.S. Cl. ..... 399/174; 399/176
(58) Field of Search ..... 399/115, 168, 399/174, 176; 428/35.8, 36.9, 36.92; 492/48, 49, 56; 361/221, 225

(56) References Cited

U.S. PATENT DOCUMENTS

| | | | | |
|---|---|---|---|---|
| 5,146,280 A | * | 9/1992 | Kisu | 399/176 |
| 5,339,141 A | | 8/1994 | Suzuki et al. | 399/285 |
| 5,424,814 A | | 6/1995 | Suzuki et al. | 399/286 |
| 5,440,373 A | | 8/1995 | Deki et al. | 399/113 |
| 5,512,984 A | | 4/1996 | Kimura et al. | 399/228 |
| 5,515,145 A | | 5/1996 | Sasaki et al. | 399/302 |
| 5,537,197 A | | 7/1996 | Fujishiro et al. | 399/228 |
| 5,565,973 A | | 10/1996 | Fujishiro et al. | 399/227 |
| 5,576,805 A | * | 11/1996 | Ishihara et al. | 399/176 |
| 5,583,630 A | | 12/1996 | Kimura et al. | 399/227 |
| 5,655,193 A | | 8/1997 | Fujishiro et al. | 399/256 |
| 5,671,465 A | | 9/1997 | Kimura et al. | 399/119 |
| 5,790,927 A | * | 8/1998 | Miyase et al. | 399/176 |
| 5,799,229 A | | 8/1998 | Yokoyama et al. | 399/100 |
| 5,946,529 A | | 8/1999 | Sato et al. | 399/100 |
| 5,953,568 A | | 9/1999 | Fujishiro et al. | 399/267 |
| 6,070,030 A | | 5/2000 | Fujishiro | 399/111 |
| 6,088,551 A | | 7/2000 | Satoh et al. | 399/100 |
| 6,096,395 A | * | 8/2000 | Hayashi et al. | 428/35.9 |
| 6,295,438 B1 | | 9/2001 | Fujishiro et al. | 399/346 |
| 6,381,432 B1 | * | 4/2002 | Hattori | 399/176 |

FOREIGN PATENT DOCUMENTS

| | | | |
|---|---|---|---|
| EP | 0 672 961 | | 9/1995 |
| JP | 63-208877 | * | 8/1988 |
| JP | 2949785 | | 7/1999 |
| JP | 2000-213529 | | 8/2000 |

OTHER PUBLICATIONS

Patent Abstracts of Japan, JP 04–360167, Dec. 14, 1992.
Patent Abstract of Japan, JP 03–240076, Oct. 25, 1991.
Patent Abstract of Japan, JP 02–103582, Apr. 16, 1990.
U.S. patent application Ser. No. 09/535,158, filed Mar. 24, 2000, pending.
U.S. patent application Ser. No. 09/848,320, filed May 4, 2001, pending.
U.S. patent application Ser. No. 09/873,245, filed Jun. 5, 2001, pending.
U.S. patent application Ser. No. 09/910,080, filed Jul. 23, 2001, pending.

(List continued on next page.)

*Primary Examiner*—Hoan Tran
(74) *Attorney, Agent, or Firm*—Oblon, Spivak, McClelland, Maier & Neustadt, P.C.

(57) ABSTRACT

A charge roller of the present invention includes a shaft, an elastic member affixed to the circumference of the shaft, and a plurality of spacers affixed to the elastic member. Assume that rising portions formed, when the circumference of the elastic member is ground during production, at axially opposite end portions of the elastic member each have a width of W mm in the axial direction. Then, the spacers each are positioned at a distance of at least W/9 mm from the end of the elastic member toward the center in the axial direction.

20 Claims, 10 Drawing Sheets

OTHER PUBLICATIONS

U.S. patent application Ser. No. 09/903,787, filed Jul. 13, 2001, pending.
U.S. patent application Ser. No. 09/962,899, filed Sep. 26, 2001, pending.*
U.S. patent application Ser. No. 10/073,296, filed Feb. 13, 2002, pending.*
U.S. patent application Ser. No. 10/145,899, filed May 16, 2002, pending.*

* cited by examiner

CHARGE ROLLER FOR AN IMAGE FORMING APPARATUS AND METHOD OF PRODUCING THE SAME

BACKGROUND OF THE INVENTION

1. Field of the Invention

The present invention relates to a copier, printer, facsimile apparatus or similar electrophotographic image forming apparatus and more particularly to a charge roller for an image forming apparatus and a method of producing the same.

2. Description of the Background Art

An image forming apparatus having at least one of a copier function, a printer function and a facsimile function includes a charger for uniformly charging the surface of an image carrier before the formation of a latent image. Japanese Patent Laid-Open Publication Nos. 3-240076 and 4-360167, for example, each disclose a charge roller made up of a shaft, an elastic member affixed to the circumference of the shaft, and a plurality of spacers mounted on the axially opposite end portions of the elastic member.

It has been customary to produce the charge roller by grinding the surface of the elastic member affixed to the shaft. The ground charge roller is pressed against the circumference of an image carrier with its portion between the spacers being spaced from the image carrier by a preselected gap. In this condition, a voltage is applied to the charge roller to thereby uniformly charge the surface of the image carrier. Subsequently, the charged surface of the image carrier is exposed imagewise to electrostatically form a latent image. A developing device develops the latent image for thereby producing a corresponding toner image.

The charge roller having the. above configuration reduces ozone and prevents substances contained in the elastic member from depositing on the image carrier and bringing about irregular charging. The charge roller therefore enhances the quality of the toner image.

If the gap between the charge roller and the image carrier is excessively great, the potential deposited on the image carrier is apt to noticeably deviate from a desired value and deteriorate the quality of the toner image. More specifically, each end portion of the elastic member has an outside diameter greater than the outside diameter of the intermediate portion, forming a rising portion. It has been customary to affix the spacers to the end portions of the elastic member without regard to the above fact. The rising portions, however, are likely to cause the gap between the elastic member and the image carrier to greatly deviate from a desired value even though the spacers may have a constant thickness, because the maximum diameter is not constant.

Moreover, when a voltage is applied to the charge roller, discharge is apt to occur between the edge of the rising portion where the outside diameter is maximum and the surface of the image carrier. This is because the edge protrudes toward the surface of the image carrier. The discharge brings about defective charging on the portion of the image carrier between the spacers and further aggravates the quality of the toner image.

Technologies relating to the present invention are also disclosed in, e.g., Japanese Patent Laid-Open Publication No. 2000-213529 and Japanese Patent No. 2,949,785.

SUMMARY OF THE INVENTION

It is an object of the present invention to provide a charger roller capable of preventing a gap between a charge roller and a body to be charged thereby from deviating from a desired value due to the rising portions of an elastic member, and a method of producing the same.

It is another object of the present invention to provide a charge roller capable of obviating discharge between a charge roller and a body to be charged thereby ascribable to the rising portions of an elastic member, and a method of producing the same.

It is a further object of the present invention to provide an image carrier unit and an image forming apparatus each including the above charge roller.

In accordance with the present invention, a charge roller includes a shaft, an elastic member affixed to the circumference of the shaft, and a plurality of spacers affixed to the elastic member. Assume that rising portions formed, when the circumference of the elastic member is ground during production, at axially opposite end portions of the elastic member each have a width of W mm in the axial direction. Then, the spacers each are positioned at a distance of at least W/9 mm from the end of the elastic member toward the center in the axial direction.

Also, in accordance with the present invention, a method of producing a charge roller including a shaft, an elastic member affixed to the circumference of the shaft, and a plurality of spacers mounted on the elastic member begins with a step of affixing the elastic member to the shaft. At least one of the elastic member and a grinder pressed against the elastic member is caused to rotate. The elastic member and grinder are caused to move relative to each other in the axial direction of the elastic member to thereby grind the circumference of the elastic member. A higher pressure is caused to act between the grinder and the elastic member when the grinder grinds opposite end portions of the elastic member in the axial direction than when it grinds an intermediate portion between the end portions.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
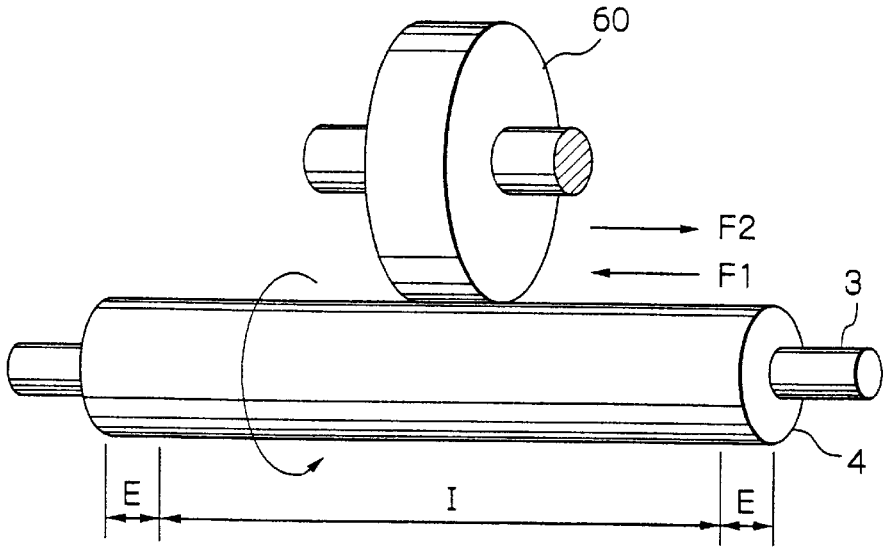
FIG. 1 is an isometric view showing a method of grinding an elastic member.
Figure 2:
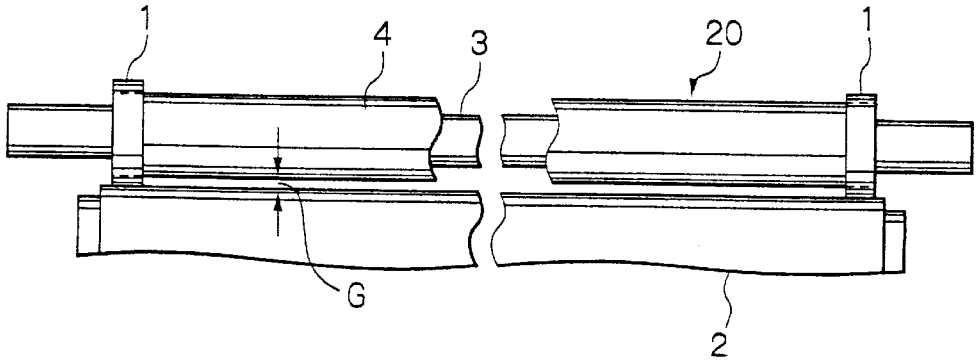
FIG. 2 is a view showing a conventional charge roller.

To better understand the present invention, reference will be made to a conventional charger roller, shown in FIG. 1. The charge roller is generally made up of a shaft 3 and an elastic member 4 affixed to the circumference of the shaft 3. To produce the charge roller, a grinder implemented as a cylindrical grindstone 60 grinds the circumference of the elastic member 4. More specifically, while the elastic member 4 and grindstone 60 each are rotated in a direction indicated by an arrow in FIG. 1, the grindstone 60 pressed against the member 4 is moved in the axial direction of the member 4 as indicated by arrows F1 and F2, thereby grinding the circumference of the member 4. The grindstone 60 cuts the elastic member 4 by, e.g., about 0.5 mm. As shown in FIG. 2, after the elastic member 4 has been so finished, spacers 1 are affixed to axially opposite ends of the member 4.

As shown in FIG. 2, the finished charge roller, labeled 20, is pressed against the circumference of an image carrier 2 with its portion between the spacers 1 being spaced from the image carrier 2 by a gap G. In this condition, a voltage is applied to the charge roller 20 to thereby uniformly charge the surface of the image carrier 2. Subsequently, the charged surface of the image carrier 2 is exposed imagewise to electrostatically form a latent Image. A developing device, not shown, develops the latent image for thereby producing a corresponding toner image.

If the gap G between the charge roller 20 and the image carrier 2 is excessively great, the potential deposited on the image carrier 2 is apt to noticeably deviate from a desired value and thereby deteriorate the quality of the toner image, as stated earlier. In light of this, I precisely examined the configuration of the finished charge roller 20 and found the following.

Part of the elastic member 4 being pressed by the grindstone 60 deforms in the radial direction due to compression. At this instant, pressure acting between the grindstone 60 and the elastic member 4 for a unit area is lower at opposite end portions E of the member 4 than at the intermediate portion I. This is presumably because the end portions E, whose end faces are free, deform more easily than the intermediate portion I in the radial direction. As a result, the outside diameter of the finished elastic member 4 is not uniform in the axial direction.

Figure 3:
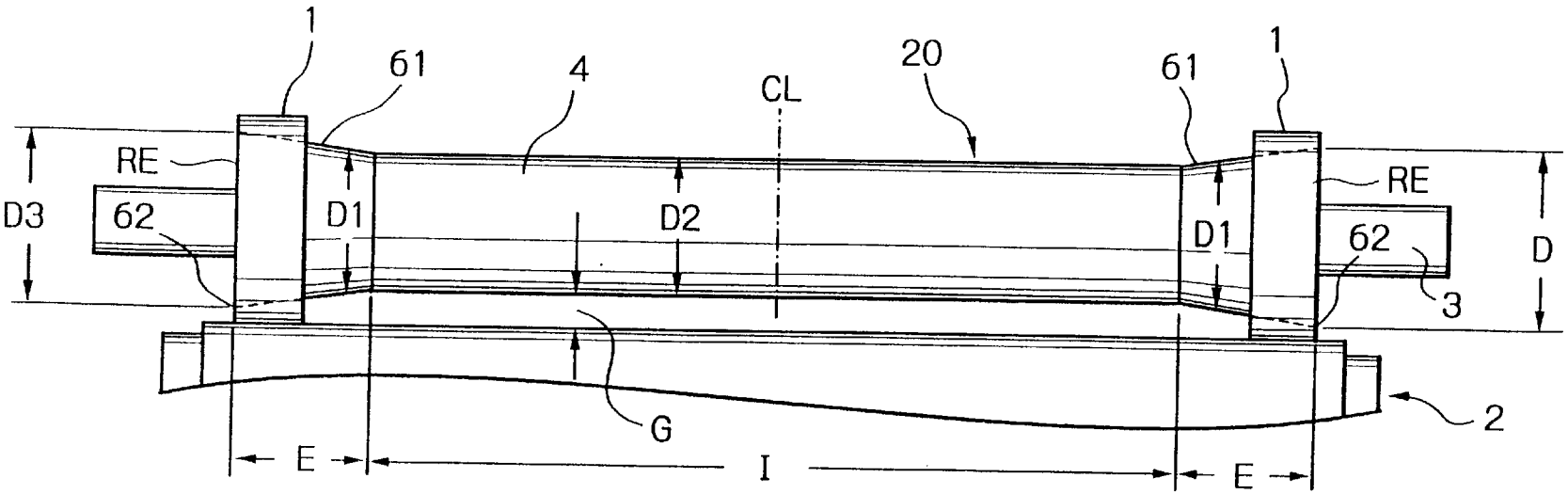
Fig. 3 PRIOR ART
FIG. 3 is a view showing, in an exaggerated scale, rising portions formed on the elastic member of the conventional charge roller.

More specifically, as shown in FIG. 3 in an exaggerate scale, each end portion E of the elastic member 4 has an outside diameter D1 greater than the outside diameter D2 of the intermediate portion I. Consequently, the end portions E each rise toward the end face (rising portion 61 hereinafter). The rising portion 61 has an outside diameter D1 that is greatest at the end RE of the elastic member 4 and sequentially decreases toward the center CL in the axial direction of the member. The difference between the outside diameter D2 of the intermediate portion I and the maximum diameter D3 of the rising portion 61 is, e.g., 40 $\mu$m to 60 $\mu$m although it depends on the configuration of the charge roller 60, the material of the elastic member 4, and so forth. Moreover, the above difference noticeably varies in accordance with environmental conditions including temperature and humidity.

It has been customary to affix the spacers 1 to the end portions or rising portions 61 of the elastic member 4 without regard to the fact described above. The rising portions 61, however, are likely to cause the gap G between the elastic member 4 and the image carrier 2 to greatly deviate from a desired value even though the spacers 1 may have a constant thickness, because the maximum diameter D3 is not constant, as discussed earlier. Further, when a voltage is applied to the charge roller 20, discharge is apt to occur between the edge 62 of the rising portion 61 where the outside diameter is D3 is maximum and the surface of the image carrier 2. This is because the edge 62 protrudes toward the surface of the image carrier 2. The discharge causes a great current to flow through the edge 62 and bring about defective charging on the portion of the image carrier 2 between the spacers 1. This further aggravates the quality of the toner image.

Figure 4:
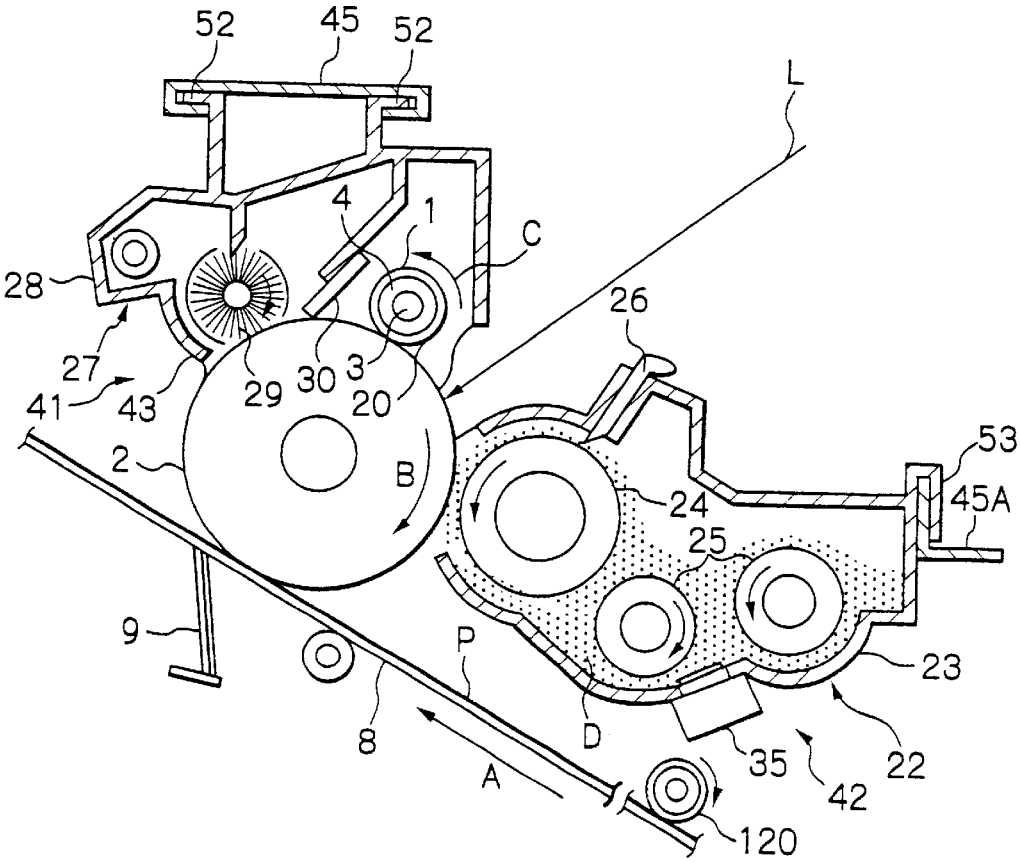
FIG. 4 is a fragmentary section showing an image forming apparatus to which the present invention is applied.

Referring to FIG. 4, part of an image forming apparatus to which the present invention is applied is shown. As shown, the image forming apparatus includes an image carrier 2 implemented as a photoconductive drum (drum 2 hereinafter). The drum 2, a charger including a charge roller 20 and a cleaner 27 are mounted on a unit case 43 together, constituting a drum unit or image carrier unit 41. A developing unit 42 includes a developing device 22. The image carrier 2 and charge roller 20 are rotatably supported by the unit case 43.

An image transfer belt 8 (belt 8 hereinafter) faces the drum 2 and is passed over a plurality of rollers, not shown, in such a manner as to run in a direction A shown in FIG. 4. The circumference of the drum 2 is held in contact with the belt 8. A brush 9, which is a specific form of an image transferring device, faces the drum 2 with the intermediary of the belt 8.

In operation, a driveline, not shown, causes the drum 2 to rotate in a direction B. The charge roller 20 is rotated by the drum 2 in a direction C with spacers 1 thereof contacting the drum 2. The charge roller 20 may be driven by an exclusive driveline, if desired.

While the drum 2 and charge roller 20 are in rotation, a voltage of preselected polarity is applied to the charge roller 20 to thereby uniformly charge the surface of the drum 2 to preselected polarity (negative polarity in FIG. 4). In this sense, the drum 2 is a body whose surface is to be charged by the charger.

A laser writing unit or exposing means, not shown, is arranged in the apparatus body in order to issue a laser beam L modulated in accordance with image data. The laser beam L scans the charged surface of the drum 2 to thereby form a latent image. In the specific case shown in FIG. 4, the portion of the drum 2 whose potential is lowered by the laser beam L in absolute value forms a latent image while the other portion forms the background of the latent image.

The developing device 22 develops the latent image with toner to thereby form a corresponding toner image. The developing device 22 includes a case 23, a developing roller 24 rotatably supported by the case 23 and driven to rotate counterclockwise, as viewed in FIG. 4, and agitators 25 also rotatably supported by the case 23 and implemented as rollers. The case 23 stores a toner and carrier mixture, i.e., a two-ingredient type developer D therein. An additive coats the grains of the developer D, as needed. Use may be made of a single-ingredient type developer, i.e., toner or a developing liquid, if desired.

The agitators 25 agitate the developer D to thereby frictionally charge the toner and carrier to opposite polarities. A bias of the same polarity as the toner is applied to the developing roller 24, so that the developer D deposits on the roller 24. The developing roller 24 conveys the developer D to a developing position between the roller 24 and the drum 2. At this instant, a doctor blade or metering member 26 regulates the amount of the developer D to reach the developing position. At the developing position, only the toner of the developer D is electrically transferred to the drum 2 to thereby develop the latent image. When the toner content of the developer D stored in the case 23 decreases, as determined by a toner content sensor 35, fresh toner is replenished to the developer D in the. case 23 via a replenishment port not shown.

A paper sheet or similar recording medium P is fed from a sheet feeder, not shown, to the belt 8. Running in the direction A, the belt 8 conveys the paper sheet P via an image transfer position between the image carrier 2 and the belt 8. A voltage opposite in polarity to the toner is applied to the brush 9 so as to transfer the toner image from the drum 2 to the paper sheet P. A fixing unit, not shown, fixes the toner image on the paper sheet P with heat and pressure. The paper sheet or print P is then driven out of the apparatus body to a tray not shown.

The cleaner 27 removes the toner left on the drum 2 after the image transfer. The cleaner 27 includes a case 28 forming part of the unit case 43. A cleaning brush 29 is supported by the case 28 and rotatable in a direction indicated by an arrow in FIG. 4. A cleaning blade 30 is affixed to the case 28 at one edge thereof. The cleaning brush 29 and cleaning blade 30 are held in contact with the drum 2 in such a manner as to scrape off the toner left on the drum 2.

The drum unit 41 includes a pair of tongues 52 that are slidably engaged with a guide 45, which is affixed to the frame of the apparatus body. The operator of the apparatus can therefore pull the entire drum unit 41 toward the front in the direction perpendicular to the sheet surface of FIG. 4 or push it toward the rear. Likewise, the case 23 of the developing device 42 includes an engaging portion 53 slidingly engaged with a guide member 45A that is included in the frame. This allows the operator to pull out the developing unit 42 toward the front or push it toward the rear, as desired.

Figure 5:
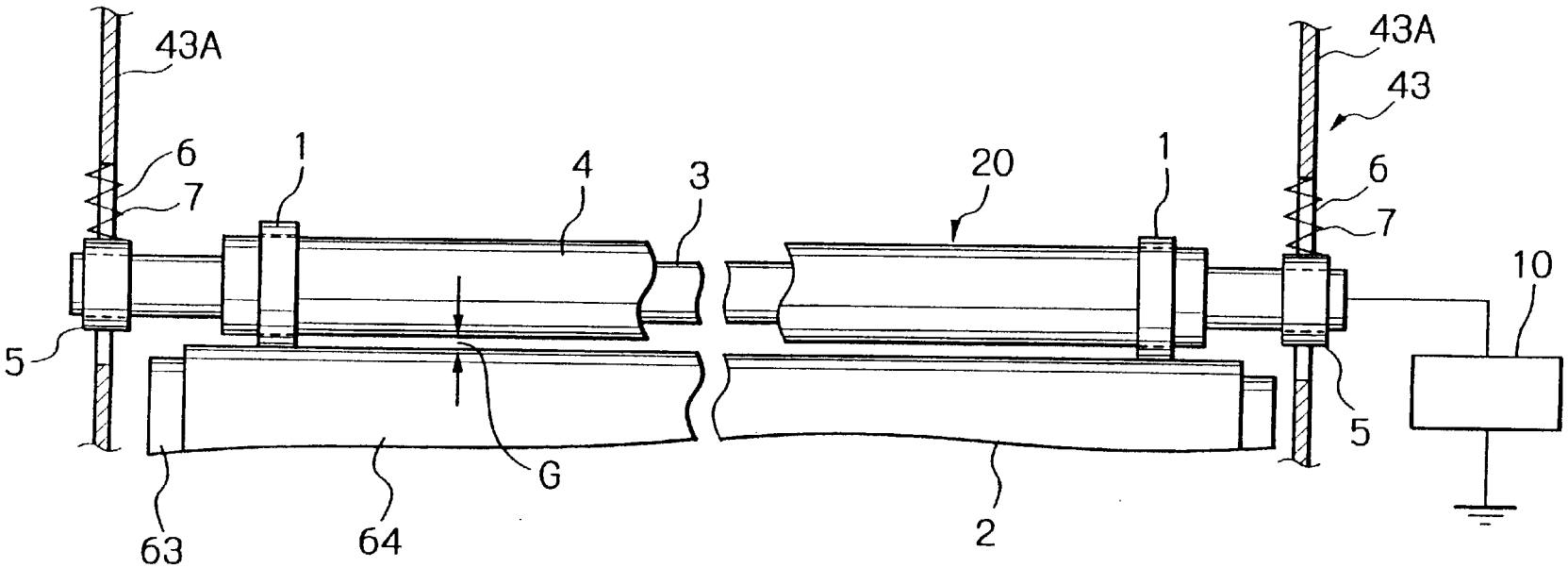
FIG. 5 is a view showing a charge roller embodying the present invention in detail.

FIG. 5 shows the charger including the charge roller 20 embodying the present invention in detail. As shown, the charge roller 20 is made up of a cylindrical or hollow, cylindrical shaft 3 formed of metal or similar conductive material, a hollow, cylindrical elastic member 4 coaxially affixed to the circumference of the shaft 3, and at least two spacers 1 affixed to the circumference of the elastic member 4. In the illustrative embodiment, two spacers 1 are mounted on opposite end portions of the elastic member 4. The elastic member 4 is formed of rubber or similar elastic material having a volume resistivity of $1\times10^3$ Ω·cm to $1\times10^8$ Ω·cm and is about 1.5 mm thick by way of example. The shaft 3 has an outside diameter of, e.g., 9 mm.

In the illustrative embodiment, each spacer 1 is made up of a base film formed of PET (polyethylene terephthalate) or similar elastic, insulating resin and an adhesive layer formed on one surface of the base film. The base film is wrapped around the elastic member 4 by one turn and affixed thereto via the adhesive layer. The spacer 1 is, e.g., 8 mm wide. The base film is, e.g., 25 μm thick while the adhesive layer is , e.g., 35 μm thick.

The shaft 3 is rotatably supported by bearings 5 at axially opposite end portions thereof. The bearings 5 are received in openings 6 formed in opposite side walls 43A. The bearings 5 each are movable toward and away from the image carrier 2 and constantly biased toward the drum 2 by a compression spring 7. In this condition, the spacers 1 are pressed against the drum 2 to thereby form a gap G between the elastic member 4 and the drum 2. A power supply 10 applies a voltage to the shaft 3 of the charge roller 20 in order to charge the surface of the drum 2, as described previously. The above voltage should preferably be a DC-biased AC voltage, e.g., an AC peak-to-peak voltage of 2 kV biased by a DC voltage of −700 V.

In the illustrative embodiment, the drum unit 41 including the charger and drum 2 and the developing unit 42 are independent of each other. Alternatively, the two units 41 and 42 may be constructed into a single drum unit, if desired.

If the gap G between the charge roller 20 and the drum 2 is excessively great, the charging of the drum 2 becomes defective and disturbs the toner image formed on the drum 2, as discussed earlier. To solve this problem, the gap G is maintained at a preselected value, i.e., 50 μm or below in the configuration shown in FIG. 4. More specifically, when each spacer 1 includes a 35 μm thick adhesive layer, the adhesive layer and the portion of the elastic member 4 where the spacer 1 is affixed elastically deform when pressed against the drum 2, implementing a gap G of 50 μm or below.

Assume that an impurity greater than the above gap G, e.g., a carrier grain whose diameter is 60 μm or above enters the gap G. Then, the elastic member 4 elastically deforms and allows the carrier grain to pass through the gap G. This protects the surface of the drum 2 from a scratch. Should the surface of the charge roller be formed of a rigid material, the carrier grain would be caught by the gap G and would thereby damage the surface of the drum 2.

The basic configuration described above applies to various specific examples to be described hereinafter.

Figure 6:
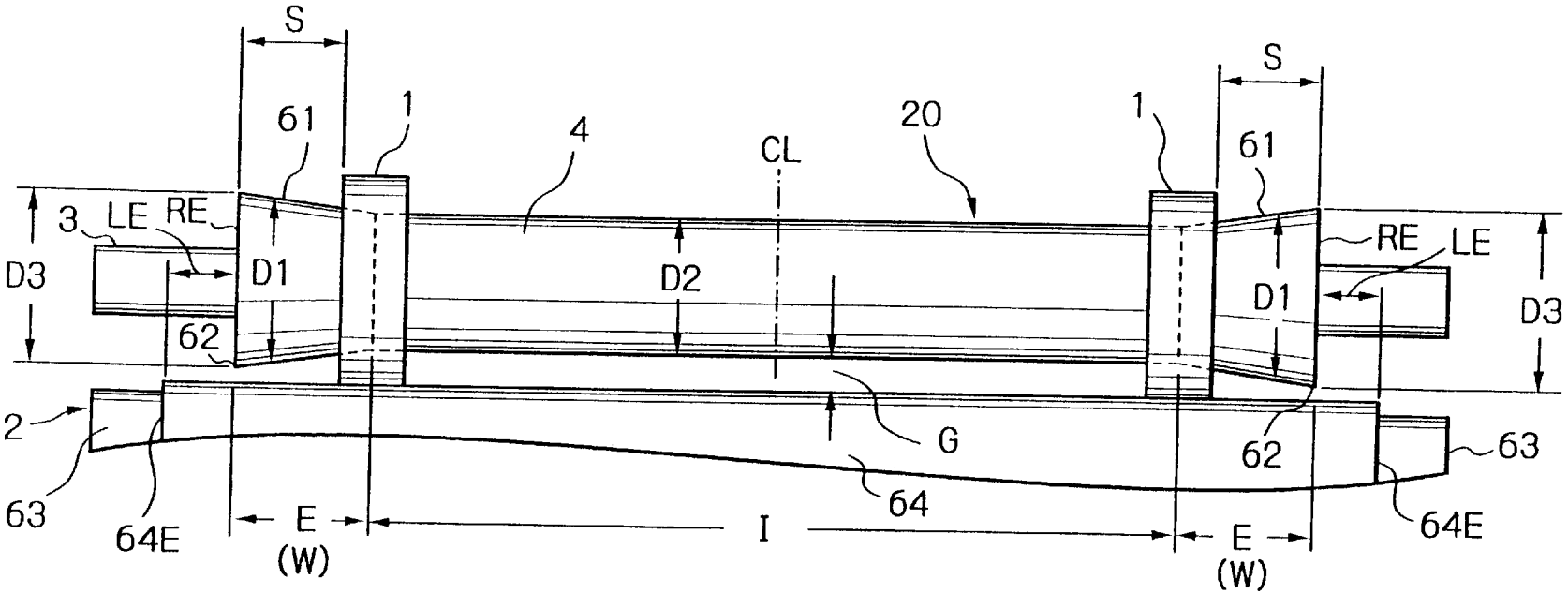
FIG. 6 is a view showing rising portions formed on the elastic member of the charge roller shown in FIG. 5.

FIG. 6 shows a specific example of the illustrative embodiment. As shown, the previously stated rising portion 61 radially protrudes from each end portion E of the elastic member 4 and extends over the entire circumference when the elastic member 4 is ground. The rising portion 61 is likely to increase the gap G between the charge roller 20 and the drum 2 above 50 μm. In this specific example, assuming that the rising portion 61 is W mm wide in the axial direction, the spacer 1 is positioned at a distance of at least W/9 mm from the end RE of the elastic member 4 toward the center CL. More specifically, the axially outermost edge of the spacer 1 is spaced from the end RE of the elastic member 4 by a distance S of W/9 mm or above toward the center CL. For example, assume that the width W of the rising portion 61 is 10 mm, and that the difference between the maximum outside diameter D3 of the rising portion 61 and the outside diameter D2 of the intermediate portion I is 50 μm. Then, the spacer 1 is spaced from the end RE of the elastic member 4 by a distance of 10/9 mm or above in the axial direction of the member 4.

The maximum outside diameter D3 of the rising portion 61 differs from one charge roller to another charge roller, as stated previously. However, the outside diameter D1 of the rising portion 61 sequentially decreases toward the center CL of the elastic member 4. It follows that the spacer 1 spaced from the end RE of the elastic member, as stated above, prevents the outside diameter of the portion of the elastic member where the spacer 1 is affixed from being noticeably scattered.

Further, in the specific example, each spacer 1 is positioned in the intermediate portion I of the elastic member 4 where the rising portions 61 are absent. In the intermediate portion I, the outside diameter of the elastic member 4 is substantially free from scattering.

Figure 7:
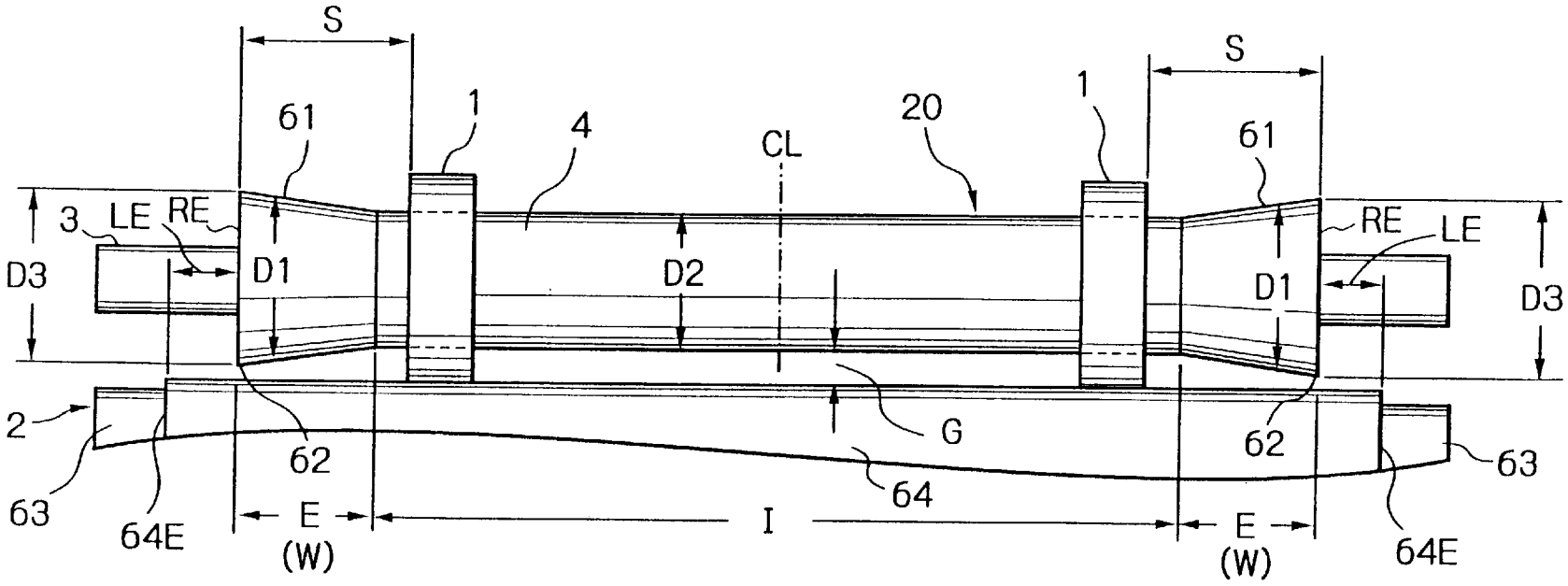
FIG. 7 is a view similar to FIG. 6, showing a pair of spacers located at positions different from the positions of FIG. 6.

When the spacers 1 are pressed against the drum 2, they successfully maintain the gap G between the portion of the elastic member between the spacers 1 and the drum 2 constant, e.g., 50 μm or below. This frees the surface of the drum 2 from defective charging and thereby enhances the quality of a toner image formed on the drum 2. As shown in FIGS. 6 and 7, assume that the drum 2 is made up of a base 63 formed of aluminum or similar conductor and a photoconductive layer 64 coated on the base 63, and that the base 63 is exposed to the outside at axially opposite ends of the drum 2. Then, discharge is apt to occur between the outermost edge 62 of the rising portion 61 and the exposed portion of the base 63. It is therefore preferable to position the end RE of the elastic member 4 and the end 64E of the photoconductive layer 64 at a preselected distance, e.g., 2 mm or above from each other in order to obviate the above discharge.

Figure 8:
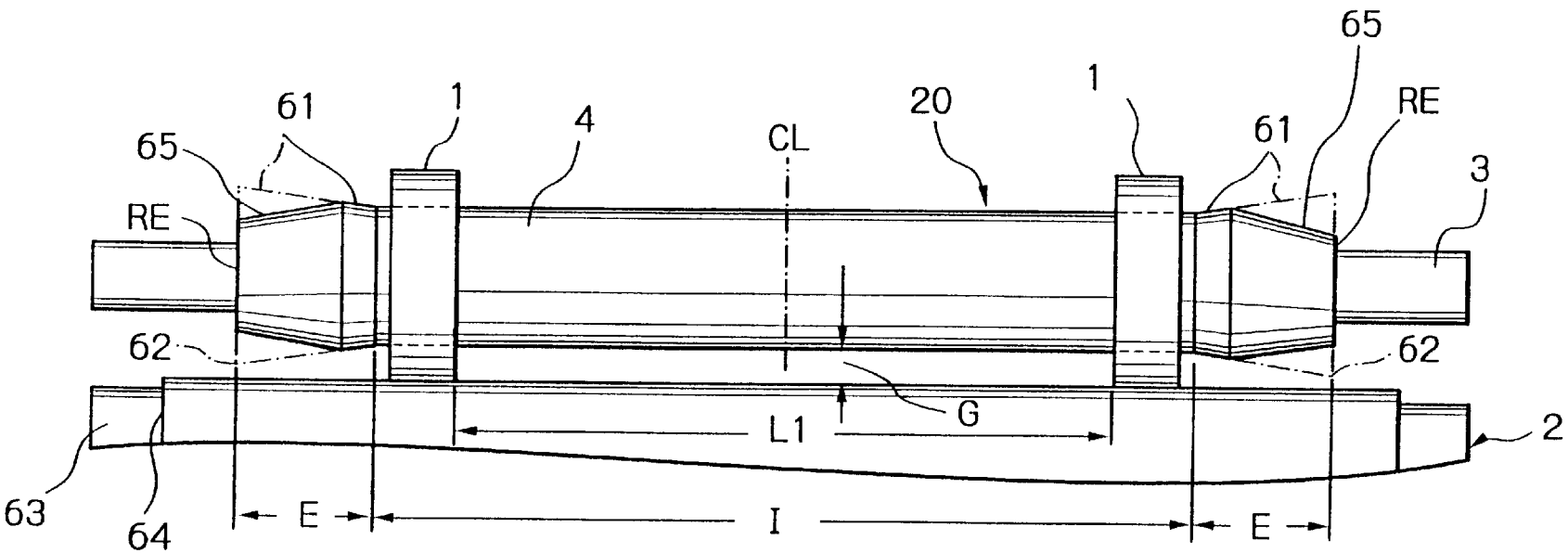
FIG. 8 is a view showing the charge roller whose rising portions are partly cut.
Figure 9:
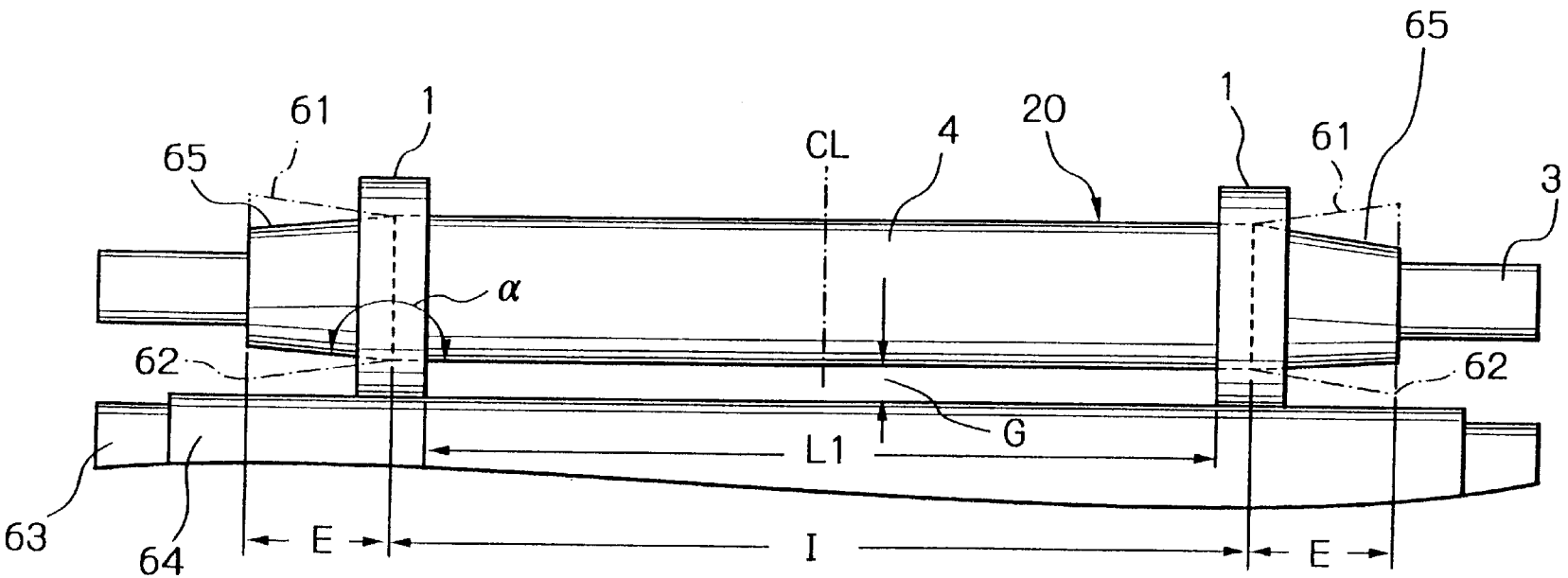
FIG. 9 is a view similar to FIG. 8, showing the charge roller whose rising portions are entirely cut.

Further, as shown in FIGS. 8 and 9, each rising aportion 61 should preferably have part thereof, which includes the maximum diameter, cut by a grindstone or a cutter, not shown, over the entire circumference. Specifically, FIG. 8 shows a case wherein the rising portion 61 is partly cut to reduce the outside diameter of the portion 61 while FIG. 9 shows a case wherein the entire rising portion 61 is cut for the same purpose. In FIGS. 8 and 9, dash-and-dots lines each show the original configuration of the rising portion 61.

In any case, the edge 62 of the rising portion 61 protruding toward the drum 2 disappears. Consequently, there are obviated not only the discharge between the end RE of the elastic member 4 and the exposed portion of the base 63 of the drum 2, but also the discharge between the end RE and the portion of the drum 2 where the photoconductive layer 64 is present. The portion of the drum 2 between the spacers 1 is therefore free form defective charging.

In FIG. 9, each spacer 1 extends over the cut surface 65 of the associated rising portion 61 and part of the elastic member 4 adjoining the cut surface 65. In FIG. 8, each spacer 1 is spaced from the cut surface 65 toward the center of the elastic member 4. This is also successful to prevent the rising portion 61 from increasing the gap G above the preselected value and therefore to free the surface of the drum 1 between the spacers 1 from defective charging.

The spacer 1 extending over the cut surface 65 and part of the elastic member 4 adjoining it, as shown in FIG. 9, adjoins the end RE of the member 4 as in the configuration of FIG. 6. The distance L1 between the spacers 1 can therefore be increased, compared to the configuration shown in FIG. 8.

On the other hand, as shown in FIG. 9, assume that an angle a between the cut surface 65 and part of the elastic member 4 adjoining it is smaller than 180°. Then, the spacer 1 extending over the cut surface 65 and the above part of the elastic member 4 has a bent shape. It follows that when part of the spacer 1 contacting the cut surface 65 is repeatedly pressed against and released from the drum 2, part of the spacer 1 contacting the cut surface 65 is apt to come off. The configuration shown in FIG. 8 is free from such a problem. In this manner, the configurations shown in FIGS. 8 and 9 have merit and demerit each.

Figure 10:
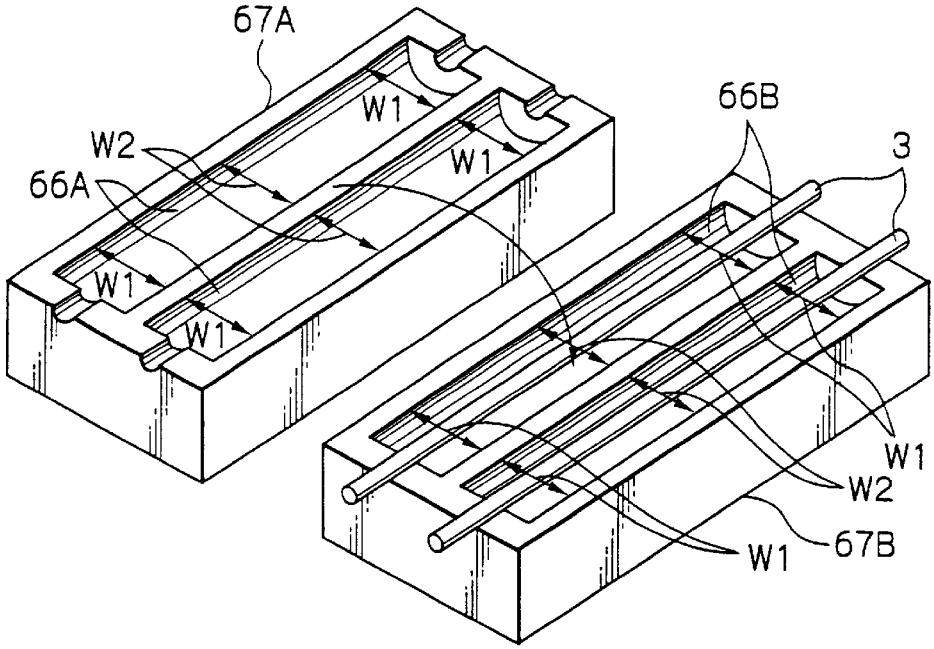
FIG. 10 is an isometric view showing a pair of molds for molding the elastic member of the illustrative embodiment.
Figure 11:
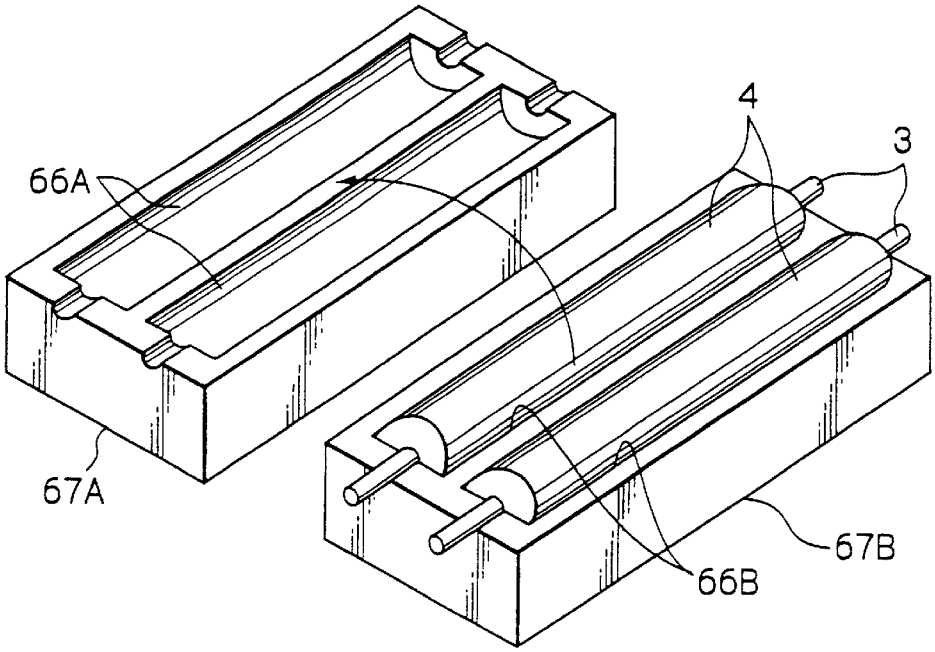
FIG. 11 is an isometric view showing the molded elastic member.

A specific procedure for producing the charge roller 20 made up of the shaft 3, elastic member 4 and spacers 1 will be described with reference to FIGS. 10 and 11. First, as shown in FIG. 10, an upper mold 67A and a lower mold 67B having cavities 66A and 66B, respectively, and identical in configuration are prepared. Subsequently, identical shafts 3 each are set in a particular cavity 66B of the lower mold 67B. As shown in FIG. 11, after the two molds 67A and 67B have been put together, the spaces between the cavities 66A and 66B are filled with molten rubber. After the molten rubber has been cooled off, the two molds 67A and 67B are separated from each other. Consequently, an elastic member 4 is formed on each of the shafts 3. The shafts 3 with the respective elastic members 4 each are removed from the lower mold 67B. Thereafter, each elastic member 4 is ground in the manner described with reference to FIG. 1.

To grind the elastic member 4, only one of the elastic member 4 and grindstone or grinder 60 may be rotated. At this instant, one or both of the elastic member 4 and grindstone 60 may be moved in the directions F1 and F2. The spacers 12 are affixed to the ground surface of the elastic member 4.

While the procedure described above is conventional, it brings about the undesirable rising portions 61 when practiced alone. An alternative procedure capable of obviating the rising portions 61 or reducing the outside diameter of the same will be described hereinafter.

The grindstone 60 grinds the surface of the elastic member 4, which is affixed to the shaft 3, with the grindstone 60 and elastic member 4 moving in the directions F1 and F2 relative to each other, as stated above. When the grindstone 60 grinds each end portion E of the elastic member 4, the pressure acting between the grindstone 60 and the elastic member 4 is made higher than when the grindstone 60 grinds the intermediate portion I of the member 4. The grindstone 60 therefore cuts the end portion E more than conventional and thereby obviates the rising portion 61 or reduces the outside diameter of the same.

Alternatively or in addition, the relative speed between the grindstone 60 and the elastic member 4 moving relative to each other may be lowered when the grindstone 60 grinds the end portion E than when it grinds the intermediate portion I. The grindstone 60 therefore cuts the end portion E more than conventional and thereby obviates the rising portion 61 or reduces the outside diameter thereof.

Figure 12:
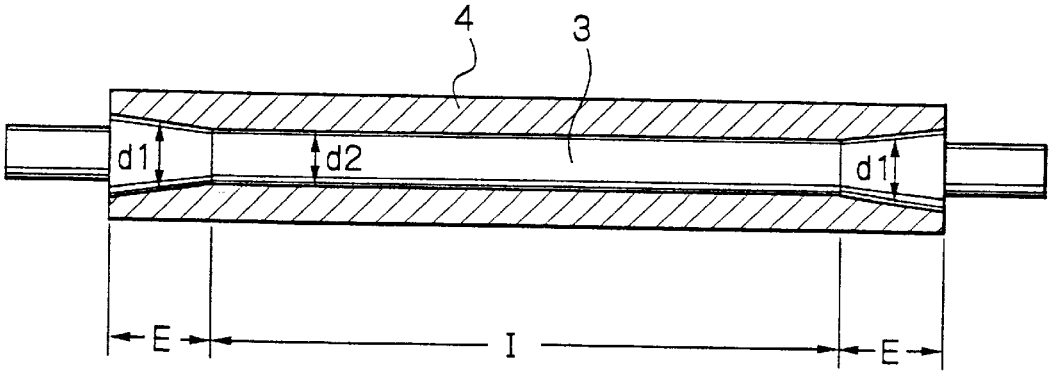
FIGS. 12 and 13 are sections each showing another specific configuration of the charge roller.

FIG. 12 shows in anexaggerated scale a shaft 3 having an outside diameter d1 at its portions to which the end portions E of the elastic member 4 are affixed, and an outside diameter d2 at a portion to which the intermediate portion I of the member 4 is affixed. The outside diameter d1 is selected to be greater than the outside diameter d2. After the elastic member 4 has been affixed to the shaft 3, the grindstone 60 grinds the circumference of the member 4 with at least one of the grindstone 60 and member 4 being rotated and with the grindstone 60 and member 4 being moved relative to each other in the axial direction. This also cuts the end portion E more than conventional and thereby obviates the rising portion 61 or reduces the outside diameter of the same. Such a procedure may be used in combination with the procedure described with reference to FIGS. 10 and 11.

Figure 13:
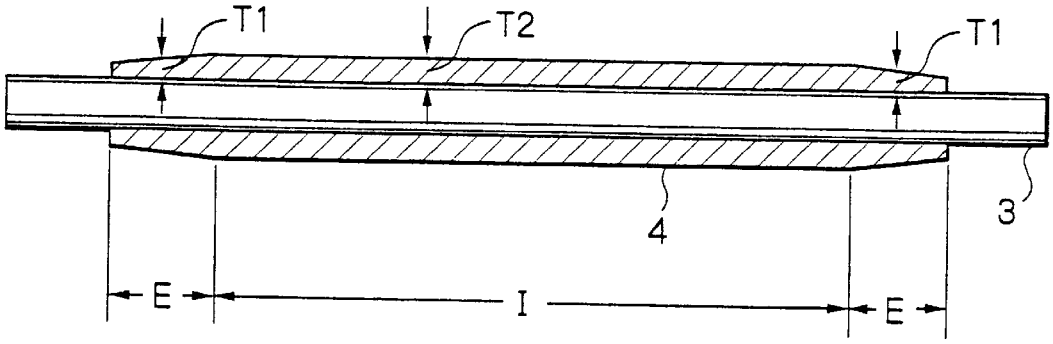

Further, the cavities 66A and 66B shown in FIG. 10 each may have a width W1 at each axial end portion and a width W2 at the intermediate portion, if desired. The width W1 is selected to be slightly smaller than the width W2. As shown in FIG. 13 in an exaggerated scale, the elastic member 4 formed by such molds 67A and 67B has a thickness T1 at opposite end portions E and a thickness T2 at the intermediate portion I that is greater than the thickness T1. After the elastic member 4 has been affixed to the shaft 3, it is ground in the same manner as described previously. Because the thickness T1 is smaller than the thickness T2, the ground elastic member 4 is free from rising portions or the outside diameter of each rising portion is reduced. This procedure may also be combined with the procedure of FIGS. 10 and 11.

The procedures described above successfully obviate rising portions or reduce the outside diameter of the same and therefore solve or effectively reduce the problems ascribable to the rising portions. In addition, the portion of the elastic member 4 between the spacers 1 can be provided with a sufficient length because the spacers 11 are located at the ends of the member or positions adjoining them.

While the illustrative embodiment has concentrated on the drum or image carrier 2, the present invention is applicable to any other body to be charged, e.g., the charge roller 20 shown in FIG. 4 and configured to charge the paper sheet P carried on the belt 8 for thereby electrostatically retaining the paper sheet P on the belt 8.

In summary, it will be seen that the present invention provides a charge roller having various unprecedented advantages, as enumerated below.

(1) An elastic member forming part of the charge roller is free from rising portions and therefore obviates problems ascribable thereto.

(2) A distance between opposite spacers can be increased.

(3) The spacers are preventing from coming off.

(4) The charge roller implements a charger achieving the above advantages (1) through (3).

(5) The charge roller implements a drum unit also achieving the above advantages (1) through (3).

(6) The charge roller implements an image forming apparatus also achieving the above advantages (1) through (7) The rising portions are obviated or the outside diameter thereof is reduced.

Various modifications will become possible for those skilled in the art after receiving the teachings of the present disclosure without departing from the scope thereof.

What is claimed is:

1. A charge roller comprising:

a shaft;

an elastic member affixed to a circumference of said shaft;

a plurality of spacers affixed to said elastic member;

said elastic member including rising portions formed thereon at axially opposite end portions of said elastic member; and said plurality of spacers each are positioned inside said rising portions at a distance from an end of said elastic member toward a center of said elastic member in the axial direction.

2. The charge roller according to claim 1, wherein said rising portions are formed when a circumference of said elastic member is ground during production, and said plurality of spacers each are positioned in a particular part of said elastic member closer to a center of said elastic member in an axial direction than a cut surface of one of said rising portions.

3. The charge roller according to claim 1, wherein each of said end portions has a width of W mm in an axial direction, and said distance from the end of the elastic member is at least W/9 mm.

4. A charge roller comprising:

a shaft;

an elastic member affixed to a circumference of said shaft;

a plurality of spacers affixed to said elastic member; and said elastic member including end portions formed thereon at axially opposite ends of said elastic member, each of said end portions having a maximum diameter cut into a circumference of said end portions to reduce a diameter of the end portions.

5. The charge roller according to claim 4, wherein said plurality of spacers are each configured to extend over a cut surface of one of the end portions and extend over a part of said elastic member closer to a center of said elastic member in an axial direction than said cut surface.

6. A charger comprising:

a charge roller having a shaft;

an elastic member affixed to a circumference of said shaft; and a plurality of spacers mounted on said elastic member;

said plurality of spacers are pressed against a body to be charged such that a part of said elastic member between said spacers and a surface of said body face each other via a gap;

said charge roller configured to charge said surface of said body with a voltage applied thereto;

said elastic member including rising portions formed thereon at axially opposite end portions of said elastic member; and said plurality of spacers each are positioned inside said rising portions at a distance from an end of said elastic member toward a center of said elastic member in the axial direction.

7. The charger according to claim 6, wherein said rising portions are formed when a circumference of said elastic member is ground during production, and said plurality of spacers each are positioned in a particular part of said elastic member closer to a center of said elastic member in an axial direction than a cut surface of one of said rising portions.

8. The charger according to claim 6, wherein each of said end portions has a width of W mm in an axial direction, and said distance from the end of the elastic member is at least W/9 mm.

9. A charger comprising:

a charge roller having a shaft;

an elastic member affixed to a circumference of said shaft; and a plurality of spacers mounted on said elastic member;

said plurality of spacers are pressed against a body to be charged such that part of said elastic member between said plurality of spacers and a surface of said body face each other via a gap;

said charge roller configured to charge said surface of said body with a voltage applied thereto;

said elastic member having end portions formed thereon at axially opposite ends of said elastic member, each of said end portions having a maximum diameter cut into a circumference of said end portions to reduce a diameter of the end portions.

10. The charger according to claim 9, wherein said plurality of spacers are each configured to extend over a cut surface of one of the end portions and extend over a part of said elastic member closer to a center of said elastic member in an axial direction than said cut surface.

11. In an image carrier unit comprising a charger and an image carrier to be charged by said charger, said charger comprising:

a charge roller having a shaft, an elastic member affixed to a circumference of said shaft, and a plurality of spacers mounted on said elastic member;

said elastic member including rising portions formed thereon at axially opposite end portions of said elastic member; and said plurality of spacers each are positioned inside said rising portions at a distance from an end of said elastic member toward a center of said elastic member in the axial direction.

12. The image carrier unit according to claim 11, wherein said rising portions are formed when a circumference of said elastic member is ground during production, and said plurality of spacers each are positioned in a particular part of said elastic member closer to a center of said elastic member in an axial direction than a cut surface of one of said rising portions.

13. The image carrier unit according to claim 11, wherein each of said end portions has a width of W mm in an axial direction, and said distance from the end of the elastic member is at least W/9 mm.

14. In an image carrier unit comprising a charger and an image carrier to be charged by said charger, said charger comprising:

a charge roller having a shaft, an elastic member affixed to a circumference of said shaft, and a plurality of spacers mounted on said elastic member;

said elastic member including end portions formed thereon at axially opposite ends of said elastic member, each of said end portions having a maximum diameter cut into a circumference of said end portions to reduce a diameter of the end portions.

15. The image carrier unit according to claim 14, wherein said plurality of spacers are each configured to extend over a cut surface of one of the end portions and extend over a part of said elastic member closer to a center of said elastic member in an axial direction than said cut surface.

16. An image forming apparatus comprising:

a charger having a charge roller including a shaft;

an elastic member affixed to a circumference of said shaft;

a plurality of spacers mounted on said elastic member;

said elastic member including rising portions formed thereon at axially opposite end portions of said elastic member; and said plurality of spacers each are positioned inside said rising portions at a distance from an end of said elastic member toward a center of said elastic member in the axial direction.

17. The image forming apparatus according to claim 16, wherein said rising portions are formed when a circumference of said elastic member is ground during production, and said plurality of spacers each are positioned in a particular part of said elastic member closer to a center of said elastic member in an axial direction than a cut surface of one of said rising portions.

18. The image forming apparatus according to claim 16, wherein each of said end portions has a width of W mm in an axial direction, and said distance from the end of the elastic member is at least W/9 mm.

19. An image forming apparatus comprising:

a charger having a charge roller including a shaft;

an elastic member affixed to a circumference of said shaft;

a plurality of spacers mounted on said elastic member;

said elastic member including end portions formed thereon at axially opposite ends of said elastic member, each of said end portions having a maximum diameter cut into a circumference of said end potions to reduce a diameter of the end portions.

20. The image forming apparatus according to claim 19, wherein said plurality of spacers each extend over a cut surface of one of the end portions and extend over a part of said elastic member closer to a center of said elastic mender in an axial direction than said cut surface.

* * * * *